215-216 SR
10/22/85 OR 4,548,329

United States Patent [19]
Curry

[11] Patent Number: 4,548,329
[45] Date of Patent: Oct. 22, 1985

[54] CHILD RESISTANT/TAMPER RESISTANT CAP

[76] Inventor: John J. Curry, P.O. Box 5, Oak Brook, Ill. 60521

[21] Appl. No.: 641,392

[22] Filed: Aug. 16, 1984

[51] Int. Cl.[4] ..... B65D 55/02
[52] U.S. Cl. ..... 215/216; 215/252
[58] Field of Search ..... 215/216, 252, 253, 258, 215/256

[56] References Cited

U.S. PATENT DOCUMENTS 4,452,363 6/1984 Davis ..... 215/216
4,471,878 9/1984 Davis et al. ..... 215/216

*Primary Examiner*—George T. Hall
*Attorney, Agent, or Firm*—Charles A. Brown

[57] ABSTRACT

This relates to a closure cap which in addition to its threaded connection with a container neck finish is also provided with an interlock with the neck finish so as to prevent rotation of the closure cap relative to the neck finish. The neck finish includes a lower shoulder having a projecting external teeth and the closure cap is provided with a lower locking band having internal teeth which engage with the external teeth to prevent rotation of the closure cap. In the simplest form of the invention, that portion of the locking band having internal teeth is removable to release the closure cap and thus give evidence of tampering. In other embodiments, while a portion of the locking band is released, the remaining portions still have teeth which engage the teeth on the neck finish to prevent cap rotation. The remaining locking band portion is of a construction whereby when squeezed in generally diametrically opposite relation the internal teeth carried thereby will move radially outwardly and disengage from the neck finish teeth so as to release the closure cap for rotation and removal.

16 Claims, 12 Drawing Figures

CHILD RESISTANT/TAMPER RESISTANT CAP

This invention in general relates to new and useful improvements in closure caps, and more particularly to a closure cap of the type having a lower locking band with internal teeth, which internal teeth are lockingly engageable with external teeth on a container neck finish so as to prevent rotation of the closure cap and thus prevent removal of the closure cap from a container neck finish.

Most particularly in accordance with this invention, the closure cap locking band is divided into two portions, one of the portions having to be removed before the closure cap can be rotated to a released position.

In one form of the invention, the removable portion of the locking band is the only portion which is provided with internal teeth so that when that portion is removed, the closure cap is free to be rotated to remove the closure cap in the normal manner. Further, in that form of the invention, the removable portion constitutes a major part of the locking band and the part which is retained remains permanently attached to the remainder of the closure cap and may be considered to be a guarantee piece.

In another form of the invention, the removable locking band portion has internal teeth as does a diametrically opposite part of the locking band. When the removable portion is removed, there is an indication of tampering. However, at this stage the closure cap is still not free to be rotated for removal. The retained portion of the locking band is of a construction whereas when squeezed at diametrically opposite parts, a central portion with internal teeth will move radially away from an associated container external locking teeth to a release position whereby when so held, the closure cap may be rotated and removed.

Another feature of the invention is that in the child resistant form of the invention to facilitate actuation, the removable locking band portion is provided with an upstanding ear. Further, the locking band portion which is retained on the container is provided with a pair of remote ears which clearly indicate to one removing the closure cap where to grasp the closure cap locking band to effect a proper squeezing thereof to completely release the internal teeth of the locking band from the external teeth of a container neck finish.

Also, if desired, suitable indicia may be placed upon an end panel of the closure cap to provide specific instructions as to how the closure cap is to be actuated for removal.

With the above and other objects in view that will hereinafter appear, the nature of the invention will be more clearly understood by reference to the following detailed description, the appended claims, and the several views illustrated in the accompanying drawings.

Figure 1:
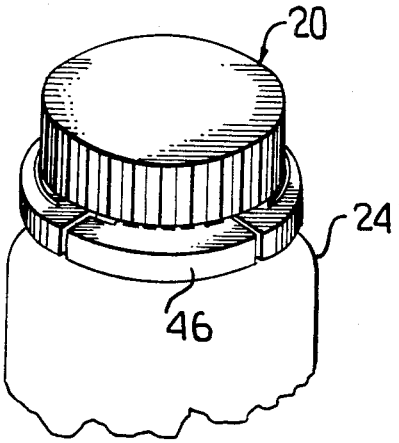
FIG. 1 is a top perspective view of one form of closure cap as applied to the neck finish of a container.
Figure 2:
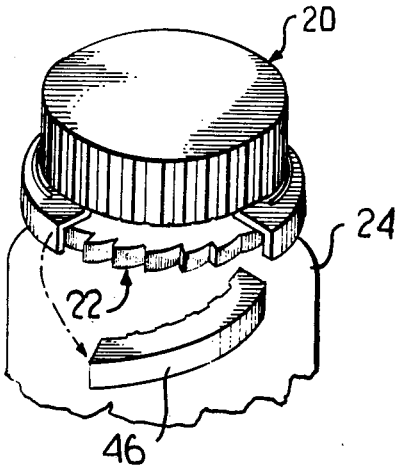
FIG. 2 is a top perspective view similar to FIG. 1 and shows the removable locking band portion removed from the closure cap with the closure cap now ready to be squeezed and removed.

Referring now to the drawings in detail, it will be seen that there is illustrated in FIGS. 1-5 a first form of closure cap incorporating my present invention, the closure cap being generally identified by the numeral 20 and being illustrated as applied to the neck finish 22 of a container 24.

Figure 3:
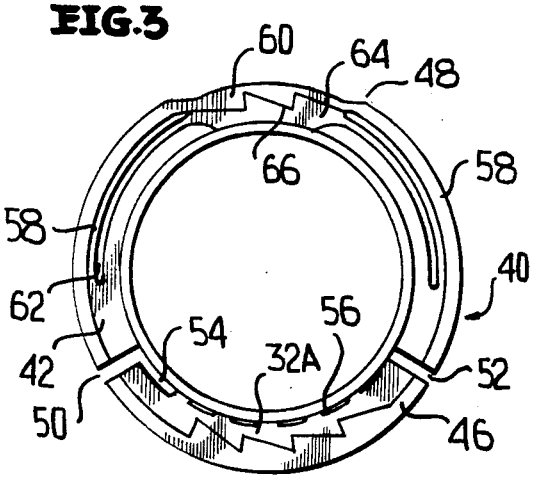
FIG. 3 is a bottom plan view of the closure cap and shows specifically the details of the internal teeth and the relationship of the portions of the locking band.
Figure 5:
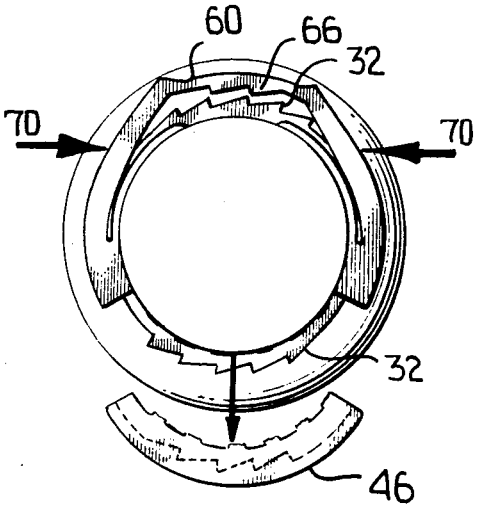
FIG. 5 is a top plan view of the closure cap and container neck finish with the removable locking band portion removed and the remaining locking band portion squeezed to release the internal teeth thereof from the external teeth of the neck finish.
Figure 4:
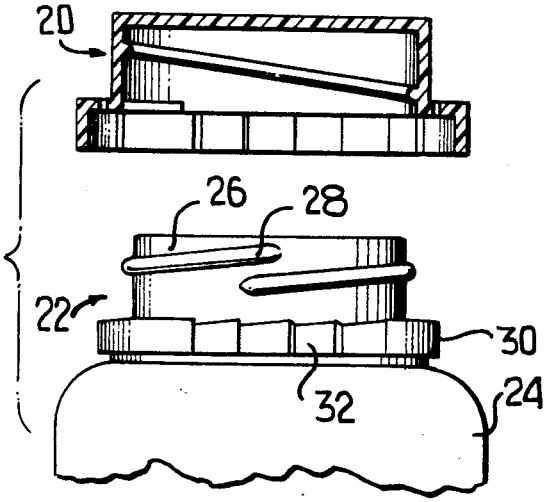
FIG. 4 is an exploded elevational view showing the container neck finish and the closure cap with portions of the closure cap being broken away and shown in section.

With particular reference to FIGS. 3, 4 and 5, it will be seen that the neck finish 22 is in part conventional in that it includes a customary neck 26 having formed thereon an external thread 28. The neck finish 22 will also include a lower shoulder 30 which is provided with diametrically opposite sets of external locking teeth 32. Although the locking teeth 32 are provided in two sets, it is feasible for the shoulder 30 to have locking teeth 32 entirely about the circumference thereof.

The closure cap 20 includes an end panel 34 and a depending skirt 36. The skirt is provided with an internal thread 38 which will mate with the external thread 28 and serve to threadedly retain the closure cap in a position closing the container 24.

The closure cap 20 also is provided with a lower locking band 40 which includes an upper annular portion 42 and a depending skirt like portion 44. As will be quite apparent from FIGS. 3 and 5, the locking band 40 is divided into two portions, a removable portion 46 and a releasable portion 48. The removable portion 46 is provided with a set of internal locking teeth 32A and is separated from the portion 48 by a pair of radial cuts 50, 52 which extend through both the annular portion 42 and the skirt 44.

The annular portion 42 of the removable locking band portion 46 is separated from the skirt 36 by a starting opening 54. It is further connected to the skirt 36 throughout the length thereof by a readily rupturable weakening line 56. The weakening line 56 may either be in the form of a score partially through the thickness of the material of the annular portion 42 or may be in the form of a plurality of readily rupturable bridges.

It will be seen that in plan the portion 48 of the locking band 40 includes two arcuate portions 58 which are joined together by a tangential portion 60. Further, in the arcuate portions 58 the annular portion 42 is provided with a pair of arcuate cuts 62 which terminate in a rather large cutout 64 which extends along the tangential portion 60. It will also be seen that the tangential portion 60 carries internal locking teeth 66 which engage with like locking teeth 32 on the container neck finish 22.

Reference is now made to FIG. 5 wherein the operations required to remove the closure cap 20 have been illustrated. First of all, the removable portion 46 of the locking band 40 is removed. This releases the closure cap from one set of teeth 32. At this time the closure cap 20 is being prevented from rotating only by the engagement of the internal teeth 66 with the second set of external teeth 32. However, by squeezing the arcuate portions 58 generally in the areas of the arrows 70, the tangential portion 60 will be caused to bow away from the second set of external locking teeth 32 so as to separate the internal locking teeth 66 therefrom. When the locking band 40 is so deformed, the closure cap 20 is free to rotate relative to the neck finish 22 and can be removed. However, if the pressure is not specifically applied generally in the area of the arrows 70 of FIG. 5, the locking teeth 66 will not disengage from the respective locking teeth 32, and rotation of the closure cap 20 cannot be effected.

Figure 6:
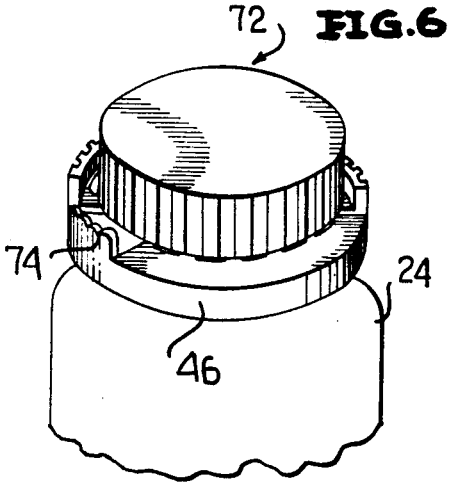
FIG. 6 is a top perspective view of a slightly modified form of closure cap.
Figure 7:
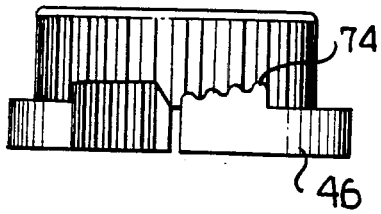
FIG. 7 is a side elevational view of the closure cap of FIG. 6.
Figure 8:
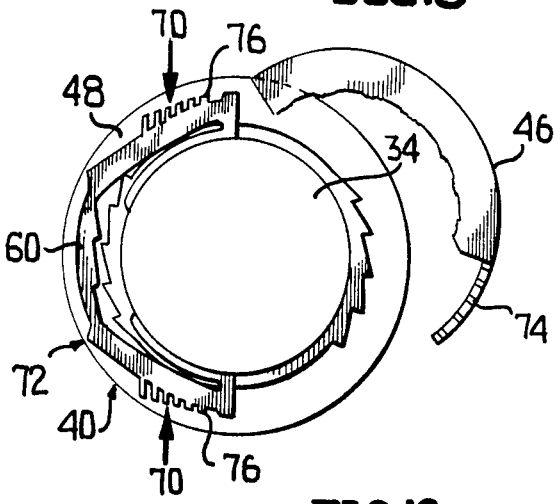
FIG. 8 is a top plan view of the closure cap of FIG. 6 as applied to a container neck finish with the removable locking band portion thereof removed and the remaining portion being squeezed to release the other internal teeth from the teeth of the container neck finish.
Figure 9:
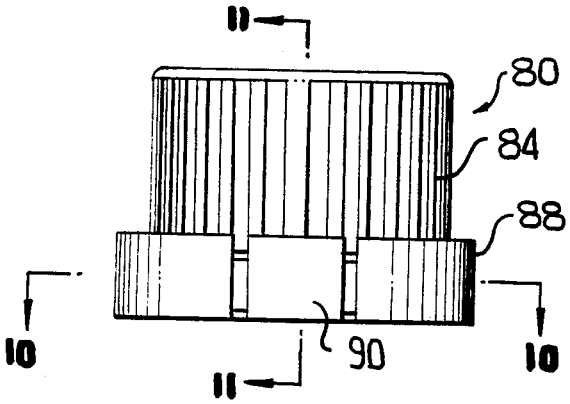
FIG. 9 is a front elevational view of yet another form of closure cap in accordance with this invention.

Reference is now made to FIGS. 6, 7 and 8 wherein there is illustrated a slightly modified form of closure cap, generally identified by the numeral 72. The closure cap 72 will be utilized in conjunction with the container neck finish 22 in the same manner as described with respect to the closure cap 20. However, there are slight differences in construction.

First of all, the removable locking band portion 46 will be provided adjacent the starting end thereof with an upstanding ear 74 adjacent the starting cut 54 so as to facilitate gripping and removal of the locking band portion 46. The configuration of the tab 74 is clearly shown in FIGS. 6 and 7.

Secondly, as is clearly shown in FIG. 8 in the areas of the non-removable locking band portion 48 which corresponds generally to the position of the arrows 70, as shown in FIG. 8, the locking band 40 is provided with a pair of radially outwardly projecting ribs 76. By providing the ribs 76, the remaining locking band portion 48 may be properly gripped to facilitate the distension of the tangential portion 60 to release the internal teeth 66 from the external teeth 32 whereby the closure cap 72 may be rotated.

As is clearly shown in FIG. 8, the end panel 34 of the closure cap 72 may be provided with suitable indicia indicating to one how to remove first the removable locking band portion 46 and then how to squeeze the remaining locking band portion 48 to effect the release of the internal teeth 66 from the external teeth 32.

A third form of closure cap, generally identified by the numeral 80 is illustrated in FIGS. 9–12. As will be apparent from these figures, the closure cap 80 includes an end panel 82, a depending skirt 84 and a lowermost locking band 86. The locking band 86 is divided into two portions, a removable portion 88 and a fixed portion 90. However, in this instance the removable portion 88 constitutes a major part of the locking band while the fixed or remaining portion 90 is relatively small.

Figure 10:
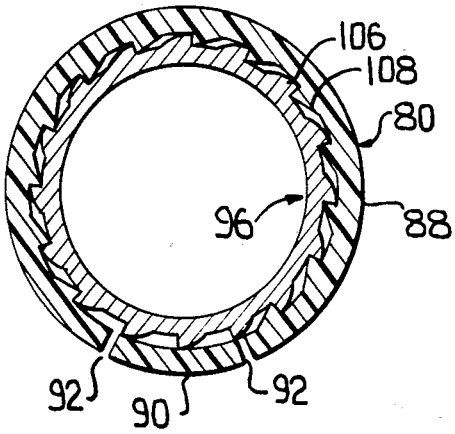
FIG. 10 is a horizontal sectional view taken generally along the line 10—10 of FIG. 9 and shows specifically the relationship of the locking band of the closure cap with external threads of a container neck finish.
Figure 11:
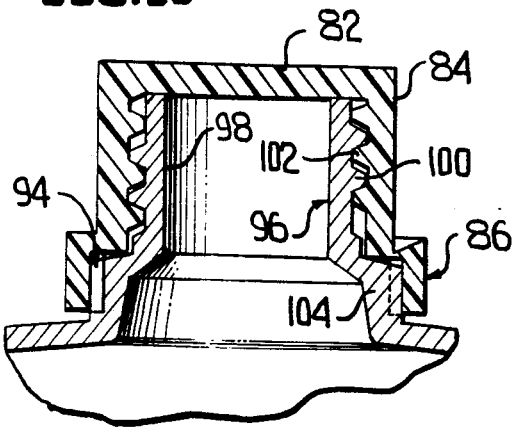
FIG. 11 is a vertical sectional view taken generally along the 11—11 of FIG. 9 and shows specifically the details of the connection between the cap locking band portion and the non-locking portion in relation to the container neck finish.

With particular reference to FIG. 10, it will be seen that the ends of the removable locking band portion 88 is separated from the fixed locking band portion 90 by a pair of radial cuts 92. The removable locking band portion 88 is connected to the skirt 84 along a weakening line 94 which, as is best shown in FIG. 11, may be in the form of a score. The weakening line 94 may in a like manner be in the form of circumferentially spaced bridges which are readily rupturable.

The closure cap 80 is particularly configurated for use in conjunction with a neck finish generally identified by the numeral 96. The neck finish 96 includes a cylindrical neck 98 which is provided with external threads 100 which are meshed with internal threads 102 formed on the skirt 84. Also, the neck finish 96 includes a lower shoulder 104 having a plurality of external teeth 106.

Returning to the closure cap 80, it will be seen that while the locking band portion 88 is provided with a plurality of internal teeth 108 which lock with the external teeth 106, the portion 90 is free of teeth so as to clear the teeth 106 on the neck finish 96.

Figure 12:
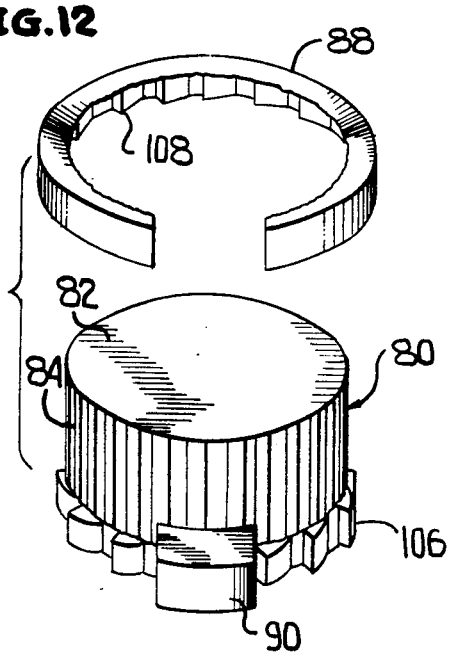
FIG. 12 is a top perspective view of the closure cap of FIG. 9 applied to a container neck finish with the tamper indicating portion of the locking band removed.

When it is desired to remove the closure cap 80 from the neck finish 96, it is merely necessary to remove the locking band portion 88 by rupturing its connection to the skirt 84 along the line of weakening 94. After the locking band portion 88 is removed, as is shown in FIG. 12, although the non-locking portion 90 remains, the closure cap 80 is free to be rotated in the customary manner to effect removal thereof.

Although in the various embodiments of the invention the internal locking teeth on the locking bands have been illustrated in a one to one ratio with respect to the external teeth on the neck finishes, it is to be understood that in order to reduce the amount, if any, of backlash, the ratio of the internal teeth to the external teeth may be on the order to 2 to 1.

Although only several preferred embodiments of the invention have been specifically illustrated and described herein, it is to be understood that minor variations may be made in the closure cap constructions without departing from the spirit and scope of the invention as defined by the appended claims.

I claim:

1. A closure cap for a container having a neck finish including external threads and a lower shoulder having external teeth, said closure cap comprising an end panel, a depending skirt and a lower locking band, said skirt having internal threads for locking rotatable engagement with a container external threads and said locking band having internal teeth for locking engagement with a container external teeth for preventing rotation of said closure cap relative to a container; the improvement wherein a portion of said locking band is integrally connected to said closure cap by rupturable means to facilitate removal of said locking band portion to permit release of said locking band from a container locking teeth, and said locking band portion forming tamper indicating means when removed.

2. A closure cap according to claim 1 wherein said locking band portion constitutes a major portion of said locking band.

3. A closure cap according to claim 1 wherein said locking band portion constitutes a major portion of said locking band and is the only portion of said locking band having said internal teeth thereon.

4. A closure cap according to claim 3 wherein said locking band also includes a permanent portion, said permanent portion being a guarantee piece which remains as a part of said closure cap when said closure cap is removed from a container.

5. A closure cap according to claim 2 wherein said locking band also includes a permanent portion, said permanent portion being a guarantee piece which remains as a part of said closure cap when said closure cap is removed from a container.

6. A closure cap according to claim 1 wherein a remainder of said locking band has thereon certain of said internal teeth, said certain internal teeth being carried by a deformable part of said locking band for temporary release from a container external teeth to make said closure cap child-proof.

7. A closure cap according to claim 6 which has diametrical opposite portions of a diameter to provide clearance thereof relative to a container neck finish whereby when said diametrical opposite portions are squeezed towards one another said certain internal teeth move radially outwardly to ineffective positions.

8. A closure cap according to claim 7 wherein said deformable portion of said locking band is separated from an adjacent portion of said skirt for radial movement away from said skirt.

9. A closure cap according to claim 6 wherein said deformable portion of said locking band is separated from an adjacent portion of said skirt for radial movement away from said skirt.

10. A closure cap according to claim 7 wherein said certain internal teeth are carried by a tangential portion of said locking band.

11. A closure cap according to claim 9 wherein said certain internal teeth are carried by a tangential portion of said locking band.

12. A closure cap according to claim 7 wherein said certain internal teeth are carried by a tangential portion of said locking band, said tangential portion being generally parallel to a line between said diametrical opposite portions.

13. A closure cap according to claim 7 wherein said diametrical opposite portions carry finger engageable ribs to assure proper squeezing.

14. A closure cap according to claim 7 wherein said diametrical opposite portions carry finger engageable ribs to assure proper squeezing, and there are instructions on said end panel specific to the gripping of said ribs.

15. A closure cap according to claim 1 wherein said locking band portion has a starting end, and there is at said starting end an upstanding pry tab for facilitating removal of said locking band portion.

16. A closure cap according to claim 13 wherein said locking band portion has a starting end, and there is at said starting end an upstanding pry tab for facilitating removal of said locking band portion.

* * * * *